United States Patent [19]

Britten

[11] 4,148,037

[45] Apr. 3, 1979

[54] RETRACTING MECHANISM FOR ANTENNA GROUND PLANE RADIALS

[75] Inventor: David P. Britten, Cosham, England

[73] Assignee: The Marconi Company Limited, Chelmsford, England

[21] Appl. No.: 802,440

[22] Filed: Jun. 1, 1977

[30] Foreign Application Priority Data

Jun. 2, 1976 [GB] United Kingdom ..... 22823

[51] Int. Cl.[2] ..... H01Q 1/08; H01Q 9/38

[52] U.S. Cl. ..... 343/846; 343/882

[58] Field of Search ..... 343/846, 880, 881, 882, 343/915

[56] References Cited

U.S. PATENT DOCUMENTS 2,674,693 4/1954 Millet et al. ..... 343/915

2,763,002 9/1956 Fitzgerald et al. ..... 343/880

*Primary Examiner*—Eli Lieberman

*Attorney, Agent, or Firm*—Kirschstein, Kirschstein, Ottinger & Cobrin

[57] ABSTRACT

A portable aerial consisting of a vertical whip element and a number of laterally extending arms forming a ground plane. The arms are resiliently pivoted at their inner ends in a mechanism which permits the arms to be deflected downwards and to return to their operative positions but which locks them in an upward position if they are deflected too far upwardly. The aerial can then be inserted through small apertures in trees etc. The obstructing branches deflecting the arms downward, temporarily, on entry and upward, permanently, on withdrawal.

6 Claims, 3 Drawing Figures

RETRACTING MECHANISM FOR ANTENNA GROUND PLANE RADIALS

This invention relates to a retracting mechanism for enabling a structure to pass through an aperture. It is particularly, although not exclusively, suited for use with a portable aerial having extended arms, when the aerial has to be erected through apertures in neighbouring obstructions, for example through the branches of trees.

According to one aspect of the present invention, therefore, a retracting mechanism comprises a plurality of arms extending from and pivotally mounted on a structure so as to be pivotable in planes containing a particular axis of the structure or containing lines parallel to this axis, each of the arms having a stable position in which its inner end is located by resilient means from which the inner end can escape by a sufficient pivotal movement of the outer arm in one, but not the opposite, direction along said axis, the arms thereby being retractable and automatically re-extendable for insertion, in said one direction, through an aperture of less than the extent of the arms in their stable position, while being permanently retractable when the inner ends of said arms escape from said resilient means on withdrawal from the aperture.

In a particular application of the invention, an aerial comprises a longitudinal conductor and a mechanism as aforesaid, the longitudinal conductor being mounted on and extending axially from said structure in said one direction and said arms forming, in their stable positions, a ground plane for the aerial.

The resilient means locating the inner end of each arm preferably comprises a first resilient or resiliently mounted member which is displaced, by sufficient movement of the associated arm in said one direction, from a position in which it can resist said movement, the resilient means then further comprising a second resilient or resiliently mounted member which resists movement of the associated arm in said opposite direction for the maximum possible extent of such movement.

The first member is resiliently mounted on said second member, which may be common to the resilient means of each arm. The first member may be exclusive to a respective arm.

The second member may be a plate which engages the inner ends of all of the arms and which is biassed into engagement with a plurality of fixed abutments to determine the stable positions of the arms.

One embodiment of a mechanism in accordance with the invention, for use with a radio aerial, will now be described, by way of example, with reference to the accompanying drawings, of which:

Figure 1:
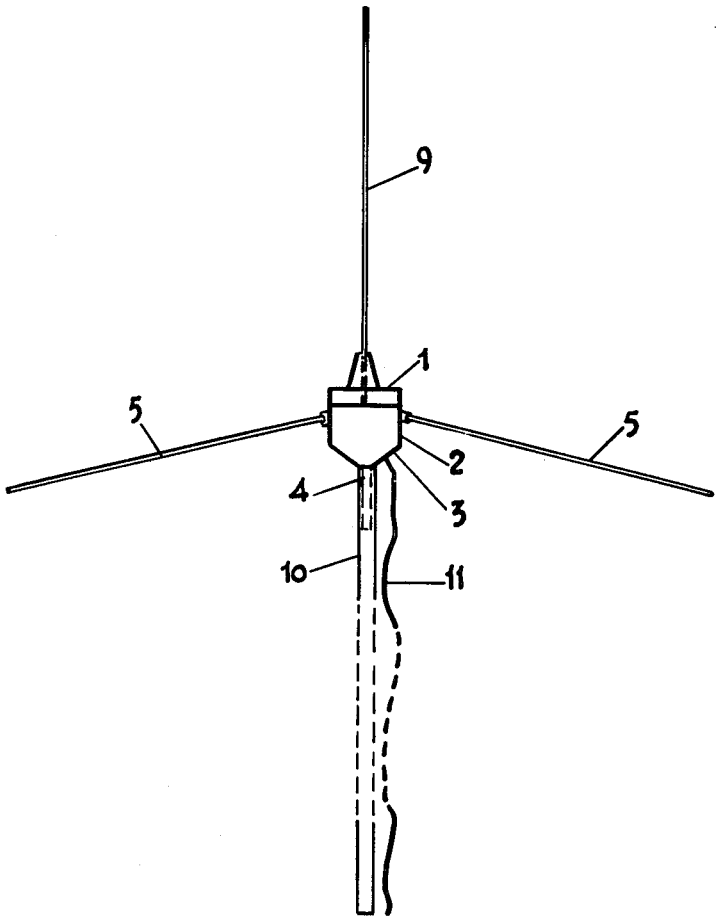
FIG. 1 is a diagrammatic view of the aerial in an erected condition on a mast.

Referring to the drawings, the aerial comprises a straight conductor 9 (the 'whip' of the whip aerial) mounted in and extending vertically upwards from an insulating base 1. The base 1 is bolted on to a structure 2 which forms a housing for the mechanism. The structure 2 is of cylindrical form having a lower part 3 of inverted conical form the apex of which is welded to the upper end of a spigot 4. The spigot 4 fits into the tubular end of a mast 10 which enables the aerial to be raised to a significant height.

An artificial ground plane for the aerial is provided by a number of radial arms 5. Two such arms are shown in the drawings but it will be seen from FIG. 2 that there is provision for up to six. Three is, however, a practical minimum.

The whip conductor 9 then forms one quarter-wave element and the 'ground plane' provides another by reflection. The whip conductor 9 is connected to one conductor of a coaxial cable 11 and the ground plane arms 5 in common to the other. It is, of course, necessary to insulate the single whip aerial conductor 9 from the ground plane arms 5.

Figure 2:
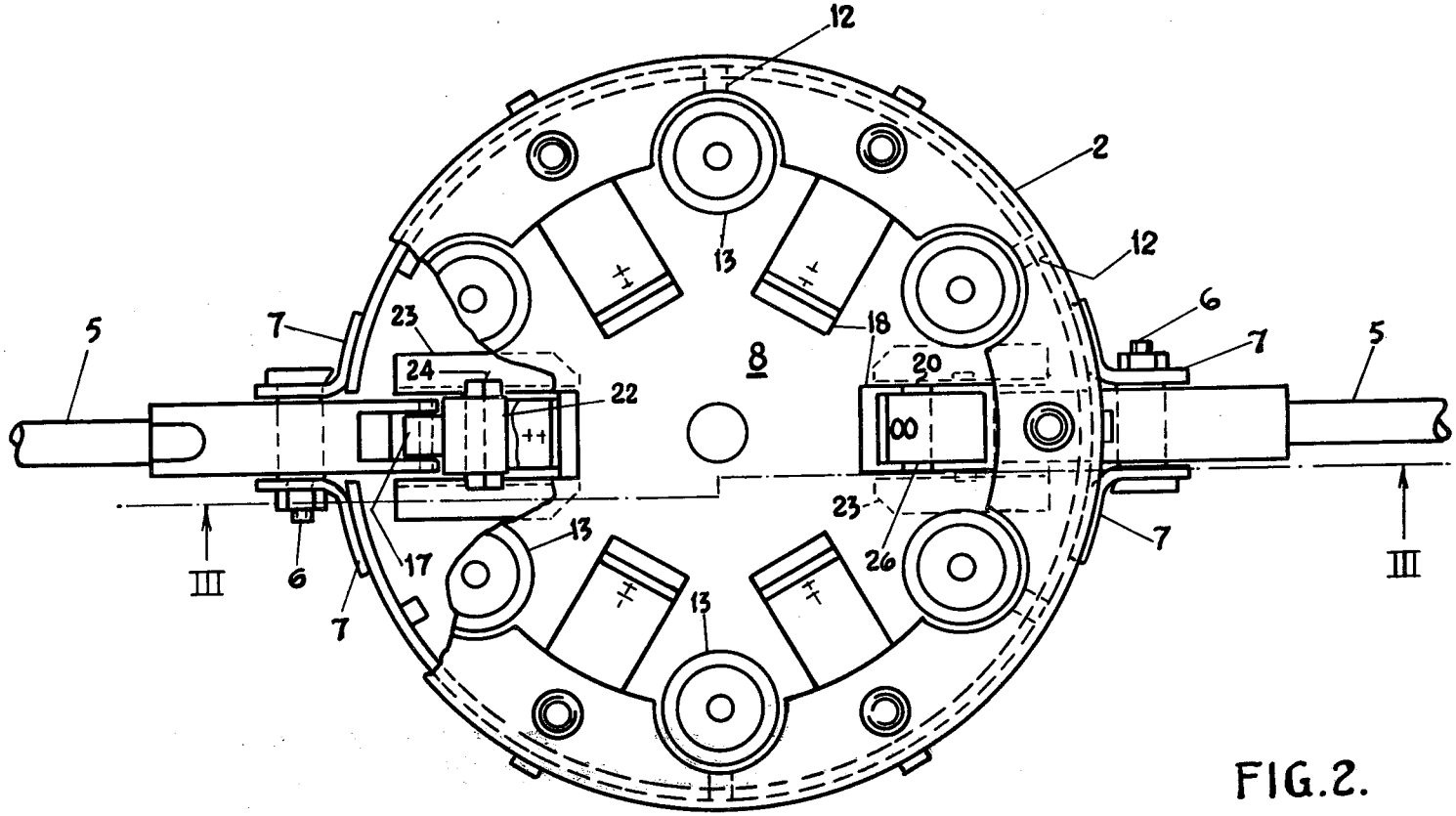
FIG. 2 is a sectional plan view of the mechanism on the line II—II of FIG. 3.
Figure 3:
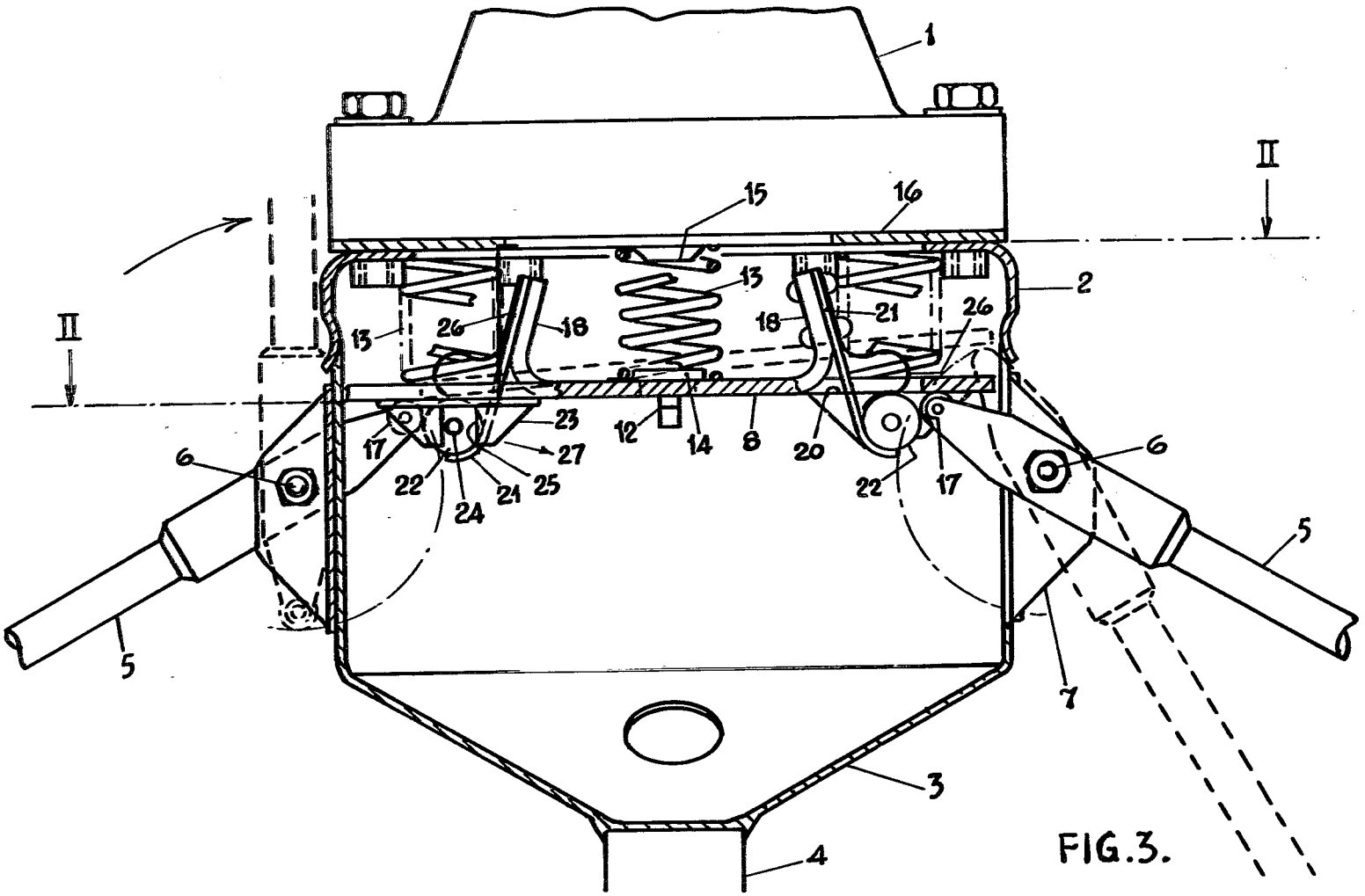
FIG. 3 is a sectional elevation of the mechanism on the line III—III of FIG. 2, FIGS. 2 and 3 being to a larger scale than FIG. 1.

Referring to FIGS. 2 and 3 particularly, each arm 5 is pivoted on a pin 6 near its inner end in a pair of brackets 7 welded on to the housing structure 2. The latter has a slot in its wall at each arm position to allow the arm to extend into the structure.

Inside the structure 2 is a plate 8 which resets on six bracket abutments 12 fixed on to the inner wall of the housing structure 2. The plate 8 is in fact biased into engagement with these brackets 12 by six springs 13 disposed around the plate symmetrically. These springs locate on bosses 14 on the plate 8 and corresponding bosses 15 in an upper ring plate 16 clamped between the structure 2 and the base 1 of the aerial. The plate 8 can therefore be tilted up at any edge position against the spring bias, returning to its rest position when permitted.

The inner ends of the arms 5 are fitted with rollers 17 which bear against the underside of the plate 8. The springs 13 are sufficiently strong to withstand the compressive force on them produced by the weight of the arms 5. Clearly, however, if the arm 5 shown on the right of FIG. 3 is forced downwardly, the plate 8 is raised at that side against the compressive force of the springs 13. This situation is shown in broken lines on the right of FIG. 3.

It may be noted that even if the arm 5 is forced down until its inner end engages the structure 2, that is, the maximum possible extent of its movement, the arm does not escape the returning effect of the resiliently mounted plate 8. The roller 17 permits the arm to move smoothly and without significant friction between the positions shown by the full and broken lines on the right hand side of FIG. 2.

Six brackets 18 are formed on the plate 8 by pieces pressed out and bent upwardly. Each bracket 18 has a resilient metal strip 21 riveted to it which extends downwardly through the hole 20 in the plate 8 formed by pressing out the bracket 18. The strip 21 is curved outwardly at its lower end in which a roller 22 sits snugly, bearing against the roller 17 of the arm 5 and trapping it against the plate 8. In order to locate the roller 22 axially, two angle brackets 23 are welded to the undersurface of the plate 8 on each side of the hole 20. The rollers 22 are formed with integral stub axles 24 which lie in slots 25 in the walls of the angle brackets 23 so limiting the radial movement of the roller 22 on the plate 8.

A final restriction on movement of the roller 22 is provided by a spring strip 26 which is fixed to the bracket 18 by the same rivets that fix the strip 21. The spring strip 26 curves away from the strip 21 and back again, conforming to the contour of the roller 22 and pressing it into the curve of the strip 21 and against the roller 17 of the arm 5. The roller 17 is therefore resiliently trapped in position so locating the inner end of the arm 5. A stable position of the arm 5 is thus determined, as shown in full lines in FIG. 2, this being at about 30° below the horizontal.

In preparing the aerial for operation, the arms 5 are disposed in their extended position shown in FIG. 1, and by the full lines in FIG. 3. The aerial, mounted on its mast 10 is then raised vertically to the desired height or extent of the mast, as the case may be.

If there should be any random obstructions which the ground plane arms 5 encounter as the aerial is raised the arms are forced downwardly as shown in broken lines on the right of FIG. 3. The plate 8 is forced upwards against the springs 13 until the roller 17 abuts the wall of the housing structure 2. In the great majority of cases this movement of the arm 5 will be sufficient to permit the aerial structure to pass through a restricted aperture between tree branches or other obstructions.

As the arm 5 passes through the aperture, or past the branch, as the case may be, the plate 8, under the pressure of the springs 13, will return the arm 5 to its original position shown in solid lines. With the aerial in its desired position radio communication can then proceed.

When it is required to remove the aerial the same problem may arise. In this case however, it is not necessary that the arms 5 should return to their extended position after passing an obstruction, but it is important that there is substantially no risk of the arms getting caught. When, therefore, the arm 5 encounters an obstruction while descending, the inner end of the arm, and in particular the roller 17, bears against the roller 22 and forces it initially in the direction of the arrow 27 (adjacent the left hand roller 22 in FIG. 3). The metal strip 21 has to flex in the same direction to permit this movement of the roller 22. After an initial such movement, the roller 17 passes through a 'dead-centre' position after which the roller 22 runs up the strip 21, which flexes back to its normal position (shown), against the pressure of the spring strip 26. The inner end of the arm 5 thus escapes from its resilient retaining device and then moves downwardly, to the vertical position shown in broken lines, quite freely. The arms 5 then present no further obstruction to withdrawal of the aerial.

It will be seen that the mechanism described provides a resilient locating means for the arms while in their stable operative position, urges them into that position while driving upwardly against obstruction, and allows them to escape from it if excessive force is exerted against obstruction on descending.

It will be clear that the mechanism will have applications other than in connection with aerials, where an extensive structure has to be inserted through a smaller and inaccessible aperture.

I claim:

1. An aerial comprising a longitudinal conductor, a plurality of conductor arms extendable laterally from one end of said longitudinal conductor to provide a ground plane, a retracting mechanism supporting said arms in relation to said longitudinal conductor, said mechanism comprising a pivot in respect of each of said arms, the axis of each pivot being transverse to the longitudinal conductor, resilient locating means for the inner end of each arm, said resilient locating means comprising a first resiliently mounted member in respect of each arm, said member providing an obstruction to movement of the associated arm in one direction, said obstruction being displaceable by sufficient force, and a second resiliently mounted member for resisting movement of the associated arm in the opposite direction for the total extent of such movement, said resilient locating means determining a stable position of the associated arm, from which stable position the arm can escape by a sufficient movement in said one direction along the axis of said longitudinal conductor but from which stable position the arm cannot escape by movement in said opposite direction, the mechanism permitting the arms to retract temporarily for insertion of the aerial through a restricted aperture, and to retract permanently on withdrawal of the aerial from the aperture.

2. An aerial according to claim 1, wherein said first resiliently mounted member is mounted on said second resiliently mounted member.

3. An aerial according to claim 2, wherein said second resiliently mounted member is common to the resilient locating means of each arm.

4. An aerial according to claim 1, wherein said first member is a spring biased roller.

5. An aerial according to claim 1, wherein said second member is a plate which engages the inner ends of all of said arms and which is biased into engagement with a plurality of fixed abutments to determine said stable position of said arms.

6. An aerial according to claim 1, wherein the inner end of each arm includes a roller for engagement with said first member.

* * * * *